US010710148B2

(12) United States Patent
Oxford et al.

(10) Patent No.: US 10,710,148 B2
(45) Date of Patent: Jul. 14, 2020

(54) METHODS OF FORMING FORGED FIXED-CUTTER EARTH-BORING DRILL BIT BODIES

(71) Applicant: Baker Hughes, a GE company, LLC, Houston, TX (US)

(72) Inventors: James Andy Oxford, Magnolia, TX (US); Richard Wayne Borge, Jr., Houston, TX (US); Stephen Duffy, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 201 days.

(21) Appl. No.: 15/443,413

(22) Filed: Feb. 27, 2017

(65) Prior Publication Data

US 2018/0243819 A1 Aug. 30, 2018

(51) Int. Cl.

| | |
|---|---|
| ***B21K 5/02*** | (2006.01) |
| ***E21B 10/42*** | (2006.01) |
| ***B21J 5/12*** | (2006.01) |
| ***B21J 5/02*** | (2006.01) |

(52) U.S. Cl.

CPC ..... *B21K 5/02* (2013.01); *B21J 5/025* (2013.01); *B21J 5/12* (2013.01); *E21B 10/42* (2013.01)

(58) Field of Classification Search

CPC .... B21K 5/02; E21B 10/42; B21J 5/12; B21J 5/025

USPC ..... 76/108.1, 108.2, 108.4

See application file for complete search history.

(56) References Cited

U.S. PATENT DOCUMENTS

| | | | | | |
|---|---|---|---|---|---|
| 2,136,083 | A * | 11/1938 | Nast | B21K 5/02 | 72/372 |
| 2,216,462 | A * | 10/1940 | Spang | B21K 5/02 | 72/340 |
| 2,578,351 | A * | 12/1951 | Griffiths | B21K 5/02 | 29/505 |
| 2,628,073 | A * | 2/1953 | Kless | E21B 10/00 | 175/403 |

(Continued)

FOREIGN PATENT DOCUMENTS

| | | | |
|---|---|---|---|
| EP | 0228289 | A2 | 7/1987 |
| JP | 2011256651 | A | 12/2011 |

OTHER PUBLICATIONS

International Search Report for International Application No. PCT/US2018/017026 dated May 17, 2018, 3 pages.

(Continued)

*Primary Examiner* — Hwei-Siu C Payer

(74) *Attorney, Agent, or Firm* — TraskBritt

(57) ABSTRACT

Methods for forming fixed-cutter earth-boring drill bits include retrieving a forged steel drill bit body from an inventory of substantially identical forged steel drill bit bodies including fixed blades and junk slots between the fixed blades. Cutter pockets are formed in the blades. Nozzle holes are formed in the drill bit body to provide fluid communication from an interior of the forged steel drill bit body to the junk slots. Additional methods include forging first and second steel drill bit bodies substantially identical in shape and configuration, forming first cutter pockets in the first steel drill bit body in a first configuration, and forming second cutter pockets in the second steel drill bit body in a second, different configuration.

17 Claims, 5 Drawing Sheets

(56) References Cited

U.S. PATENT DOCUMENTS

| | | | | |
|---|---|---|---|---|
| 4,127,043 | A * | 11/1978 | Evans | E21B 10/20 175/369 |
| 4,256,194 | A | 3/1981 | Varel | |
| 4,417,629 | A | 11/1983 | Wallace | |
| 4,574,895 | A * | 3/1986 | Dolezal | E21B 10/567 175/400 |
| 4,593,776 | A | 6/1986 | Salesky et al. | |
| 4,838,366 | A * | 6/1989 | Jones | E21B 10/42 175/413 |
| 5,547,033 | A | 8/1996 | Compos, Jr. | |
| 5,624,002 | A | 4/1997 | Huffstutler | |
| 6,131,677 | A * | 10/2000 | Arfele | B22C 7/023 164/34 |
| 6,651,756 | B1 | 11/2003 | Costo, Jr. et al. | |
| 8,272,295 | B2 | 9/2012 | Smith et al. | |
| 2003/0002940 | A1* | 1/2003 | Forth | B23P 6/00 408/226 |
| 2007/0102200 | A1* | 5/2007 | Choe | E21B 10/00 175/374 |
| 2007/0157763 | A1 | 7/2007 | Oldham | |
| 2008/0179107 | A1 | 7/2008 | Doster | |
| 2010/0132510 | A1 | 6/2010 | Centala et al. | |
| 2015/0204142 | A1 | 7/2015 | Cheng et al. | |
| 2016/0002980 | A1* | 1/2016 | Hellvik | E21B 10/55 175/428 |
| 2017/0044837 | A1 | 2/2017 | Moslemi et al. | |
| 2017/0113264 | A1* | 4/2017 | Oxford | B23K 20/129 |
| 2018/0243819 | A1* | 8/2018 | Oxford | E21B 10/42 |

OTHER PUBLICATIONS

International Written Opinion for International Application No. PCT/US2018/017026 dated May 17, 2018, 10 pages.

* cited by examiner

METHODS OF FORMING FORGED FIXED-CUTTER EARTH-BORING DRILL BIT BODIES

FIELD

Embodiments of the present disclosure relate to methods for forming fixed-cutter earth-boring drill bit bodies and drill bits, such as those made from steel.

BACKGROUND

Earth-boring tools for forming wellbores in subterranean earth formations may include a plurality of cutting elements secured to a body. For example, fixed-cutter earth-boring rotary drill bits (also referred to as "drag bits") include fixed blades and cutters secured to the fixed blades. It is known to form fixed-cutter steel drill bits by: (1) rough turning a wrought alloy bar; (2) heat treating the turned bar; (3) forming threads on the turned bar for connection of the drill bit to another sub, drill collar, or drill pipe; (4) machining a profile of the bit crown; (5) milling blades, junk slots, waterways, nozzle holes, and cutter pockets in the bit crown; (6) positioning cutters within the cutter pockets; and (7) positioning nozzles within the nozzle holes. This fabrication process is performed individually for each drill bit, based on a preselected design, including position, length, width, angle, and other parameters of the blades, drilling profile, cutters, nozzles, etc. Such fabrication processes are often time-consuming and expensive.

BRIEF SUMMARY

In some embodiments, the present disclosure includes methods of forming fixed-cutter drill bits for earth-boring operations. In accordance with such methods, a forged steel drill bit body is retrieved from an inventory of substantially identical forged steel drill bit bodies, the forged steel drill bit body including fixed blades and junk slots between the fixed blades. Cutter pockets are formed in the blades. Nozzle holes are formed in the forged steel drill bit body to provide fluid communication from an interior of the forged steel drill bit body to the junk slots.

In some embodiments, the present disclosure includes additional methods of forming fixed-cutter drill bits for earth-boring operations. In accordance with such additional methods, a first steel drill bit body including first fixed blades is forged. A second steel drill bit body including second fixed blades is forged. The second steel drill bit body is at least substantially identical to the first steel drill bit body in shape and configuration. First cutter pockets are formed in a first configuration along the first fixed blades of the first steel drill bit body. Second cutter pockets are formed in a second configuration along the second fixed blades of the second steel drill bit body. The second configuration is different from the first configuration.

In some embodiments, the present disclosure includes methods of forming fixed-cutter earth-boring drill bits. In accordance with such methods, a steel material is forged into a drill bit intermediate structure that includes a crown portion and a shank portion in an integral, unitary body. The crown portion includes blades, junk-slots between the blades, and hard-facing grooves along leading edges of the blades. Threads are formed on the shank portion to form a connection region for connecting the shank to an adjacent sub, drill collar, or drill pipe. Cutter pockets are formed along the blades. Nozzle holes are formed to provide fluid communication between the junk slots and a central fluid conduit of the drill bit intermediate structure. A hard-facing material is positioned within the hard-facing grooves. Cutters are positioned within the cutter pockets.

DETAILED DESCRIPTION

Figure 1:
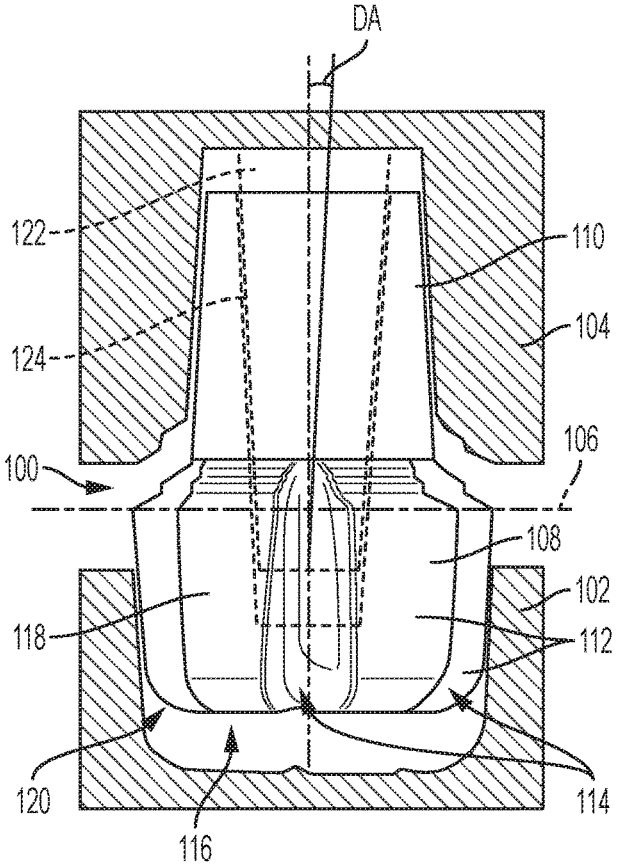
FIG. 1 shows a side view of a drill bit body intermediate structure and forging dies according to an embodiment of the present disclosure.

The following description provides specific details, such as material types, material thicknesses, and configurations of elements in order to provide a thorough description of embodiments of the present disclosure. However, a person of ordinary skill in the art will understand that the embodiments of the present disclosure may be practiced without employing these specific details. Indeed, the embodiments of the present disclosure may be practiced in conjunction with conventional techniques and materials employed in the industry.

In the following detailed description, reference is made to the accompanying drawings, which form a part hereof, and in which is shown, by way of illustration, specific embodiments in which the present disclosure may be practiced. These embodiments are described in sufficient detail to enable a person of ordinary skill in the art to practice the present disclosure. However, other embodiments may be utilized, and changes may be made without departing from the scope of the disclosure. The illustrations presented herein are not meant to be actual views of any particular system, device, structure, or process, but are idealized representations that are employed to describe the embodiments of the present disclosure. The drawings presented herein are not necessarily drawn to scale. The drawings may use like reference numerals to identify like elements.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational term, such as "first," "second," "top," "bottom," "underlying," "upper," "lower,"

etc., is used for clarity and convenience in understanding the disclosure and accompanying drawings and does not connote or depend on any specific preference, orientation, or order, except where the context clearly indicates otherwise.

The embodiments of the present disclosure include methods for forming fixed-cutter earth-boring drill bits. Such methods may include forging an intermediate structure that includes blades and junk slots between the blades. The intermediate structure may, in some embodiments, include a crown portion (including the blades and junk slots) and a shank portion forged as an integral, unitary body. Multiple specimens of the forged intermediate structure may be held in inventory, for tailoring to specific designs and applications by further processing. For example, a forged intermediate structure may be machined to include cutter pockets along the blades and nozzle holes in different configurations (e.g., number, size, position, angle, etc.) for different applications.

Figure 2:
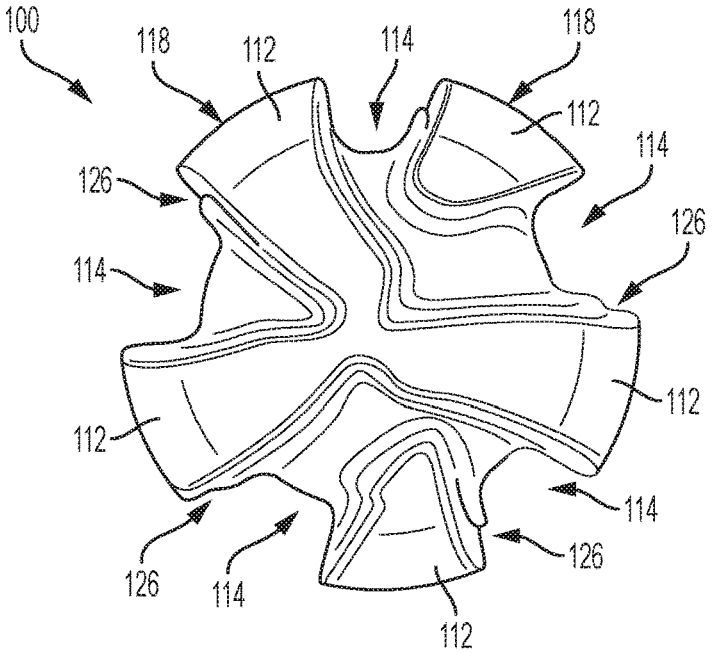
FIG. 2 shows a bottom view of the drill bit body intermediate structure of FIG. 1 according to an embodiment of the present disclosure.

A side view of an embodiment of a drill bit body intermediate structure 100, also referred to herein as an intermediate structure 100 for simplicity, is illustrated in FIG. 1, along with a first forging die 102 and second forging die 104 used to form the intermediate structure 100. A bottom view of the intermediate structure 100 is shown in FIG. 2. As used herein, the phrase "intermediate structure" refers to a structure from which a drill bit body is fabricated, but that is not yet in a final, operational state for use in drilling a formation in the earth. The intermediate structure 100 may be fabricated by forging with the first forging die 102 and the second forging die 104, which are shown in cross-section and separated from each other for clarity in FIG. 1. A split line 106 is illustrated in FIG. 1, showing a location where the first and second forging dies 102, 104 may be brought together during a forging operation to fabricate the intermediate structure 100. The forging operation may, in some embodiments, involve heating a steel material to its plastic deformation temperature (which may vary depending on the type of steel material employed) and pressing (or impact forging) the steel material between the first and second forging dies 102, 104. Prior to the forging operation, the steel material may or may not be pre-formed into a shape that approximates an internal cavity defined by the first and second forging dies 102, 104.

The intermediate structure 100 may include a crown portion 108 and a shank portion 110. In some embodiments, the intermediate structure including the crown portion 108 and shank portion 110 may be forged by the first and second forging dies 102, 104 together in an integral, unitary body. Alternatively, in some embodiments, the intermediate structure 100 may include only the crown portion 108, and the shank portion 110 may be separately fabricated and later joined to the crown portion 108, such as via one or more of threads, welding, brazing, or a press fit, for example. In such embodiments, the crown portion 108 may be forged and connection structure (e.g., threads), if any, may be machined or otherwise formed on the forged crown portion 108 for connection to the shank portion 110. The shank portion 110 may be fabricated by, for example, one or more of forging, machining, or turning prior to connection to the crown portion 108.

Referring to FIG. 1, the first forging die 102 may have an inner surface that is complementary to an outer surface of the crown portion 108 of the intermediate structure 100. The second forging die 104 may have an inner surface that is complementary to an outer surface of the shank portion 110. Outer surfaces of the intermediate structure 100 may taper inward from the split line 106 at a draft angle, to enable the first and second forging dies 102, 104 to separate from each other and from the intermediate structure upon withdrawal of the first and second forging dies 102, 104 from the split line 106. By way of example and not limitation, the outer surfaces of the intermediate structure 100 may taper inward toward a central longitudinal axis of the intermediate structure at a draft angle DA of more than zero degrees, such as at least about 3 degrees, for example. As used herein, the phrase "central longitudinal axis" refers to an axis about which a drill bit body formed according to the present disclosure is generally intended to rotate during operation.

Inner surfaces of the first forging die 102 may include recesses for forging complementary blades 112 in the intermediate structure 100. Inner surfaces of the first forging die 102 may also include protrusions for forging complementary fluid courses and junk slots 114 in the intermediate structure 100 between the blades 112. The blades 112 may include a face region 116, a gage region 118, and a shoulder region 120 at a transition between the face region 116 and the gage region 118. In some embodiments, as shown in FIG. 1, the split line 106 may be at a top (from the perspective of FIG. 1) of the gage region 118. Inner surfaces of the second forging die 104 may also include recesses and protrusions for forging upper parts of the blades 112 and junk slots 114. Due to the draft angle for facilitating withdrawal of the first and second forging dies 102, 104 from each other and from the intermediate structure 100 during the forging operation, side walls of the blades 112 defining the junk slots 114 may slightly converge from the face region 116 toward the split line 106.

The arrangement and configuration of the blades 112 and junk slots 114 of the intermediate structure 100 may be common to a number of different final drill bit bodies having cutters, nozzles, and other features in different positions, as will be explained below with reference to FIGS. 5-8.

Optionally, the second forging die 104 may include a central internal protrusion 122 (shown in dashed lines in FIG. 1) complementary to and for forming a central fluid conduit 124 (shown in dashed lines in FIG. 1) in the shank portion 110. In some embodiments, the central internal protrusion 122 may have a length sufficient to form the central fluid conduit 124 to extend into the crown portion 108, as shown in FIG. 1. Referring to FIG. 2, the second forging die 104 and/or the first forging die 102 may, in some embodiments, include protrusions for forming hard-facing grooves 126, such as along leading edges of the blades 112. The hard-facing grooves 126 may be provided for filling with a hard-facing material at locations on the intermediate structure 100 that may experience increased wear during operation. Although FIG. 2 illustrates the hard-facing grooves 126 only along the leading edges of the blades 112, hard-facing grooves 126 may be located at other positions on the intermediate structure 100, such as along trailing edges of the blades 112.

The forging of the drill bit body intermediate structure 100 may enable the reduction or elimination of conventional bit body fabrication operations. For example, the formation of the blades 112 and junk slots 114, as well as optional central fluid conduit 124 and hard-facing grooves 126, may be completed in one forging operation. Thus, the blades 112, junk slots 114, and, optionally, central fluid conduit 124 and hard-facing grooves 126, may be substantially fully formed via the forging operation, while eliminating or reducing expensive and time-consuming machining operations (e.g., turning, milling, cutting, etc.) conventionally used to form such features.

The intermediate structure 100 may be formed of a steel material. By way of example and not limitation, a material of the intermediate structure 100 may be or include a ferrous alloy steel, a carbon steel, a stainless steel, a nickel alloy steel, or a cobalt alloy steel.

Figure 3:
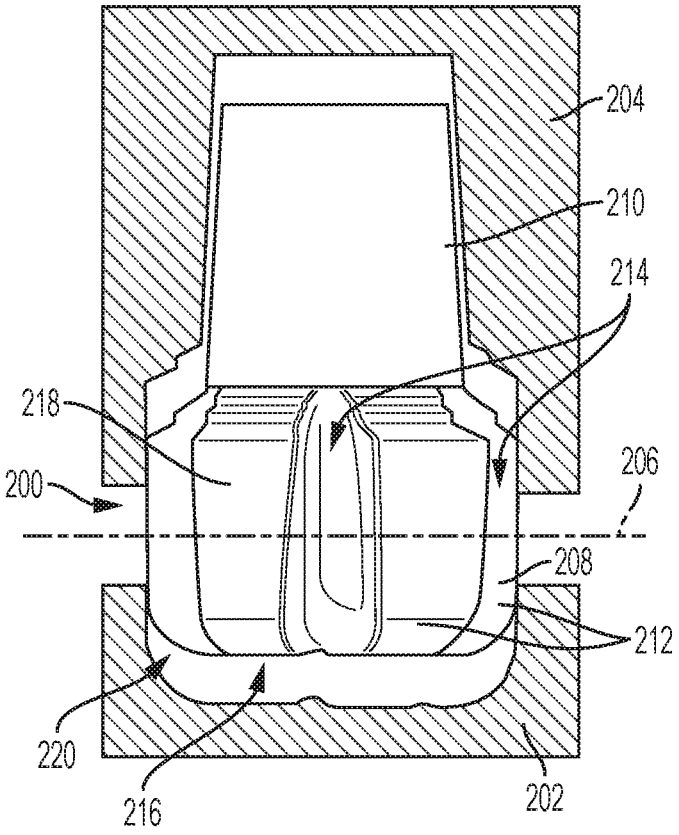
FIG. 3 shows a side view of a drill bit body intermediate structure and forging dies according to another embodiment of the present disclosure.

A side view of another embodiment of a drill bit body intermediate structure 200 is illustrated in FIG. 3, along with a first forging die 202 and second forging die 204 used to form the intermediate structure 200. Certain aspects of the intermediate structure 200 shown in FIG. 3 are similar to aspects of the intermediate structure 100 shown in FIG. 1. Accordingly, the intermediate structure 200 may include a crown portion 208, a shank portion 210, blades 212 separated by junk slots 214, a face region 216, a gage region 218, and a shoulder region 220 between the face region 216 and the gage region 218. Optionally, the intermediate structure 200 may also include a central fluid conduit and hard-facing grooves, as described above and shown in FIGS. 1 and 2. However, a split line 206, defined by a location where the first forging die 202 and the second forging die 204 come together during a forging operation, may be positioned at a different location on the intermediate structure 200 compared to the split line 106 described above with reference to FIG. 1. Rather, as shown in FIG. 3, the split line 206 may be positioned between longitudinal ends of the gage region 218. In additional embodiments, a split line may be positioned at any longitudinal location along a gage region, from a top of the gage region to a bottom of the gage region (e.g., at a shoulder region) and anywhere between the top and the bottom of the gage region.

As discussed above with reference to FIG. 1, outer surfaces of the intermediate structure 200 may be angled relative to a central longitudinal axis of the intermediate structure to facilitate withdrawal of the first and second forging dies 202, 204 from each other and from the intermediate structure 200 during a forging operation. Due to this draft angle, side walls of the blades 212 defining the junk slots 214 may slightly converge from the face region 216 toward the split line 206, then diverge from the split line 206 toward a top (from the perspective of FIG. 3) of the junk slots 214.

FIGS. 1 and 3 illustrate embodiments of intermediate structures 100, 200 in which the split line 106, 206 is positioned along a gage region 118, 218 at an orientation that is transverse (e.g., perpendicular) to a central longitudinal axis of the intermediate structures 100, 200. However, this disclosure is not limited to such embodiments. Rather, in some embodiments, such as those including two, three, or four blades, a split line may be oriented at least substantially parallel to a central longitudinal axis of a corresponding intermediate structure. In other words, the intermediate structures 100, 200 may be forged in a horizontal orientation rather than the vertical orientation illustrated in the figures.

Figure 4C:
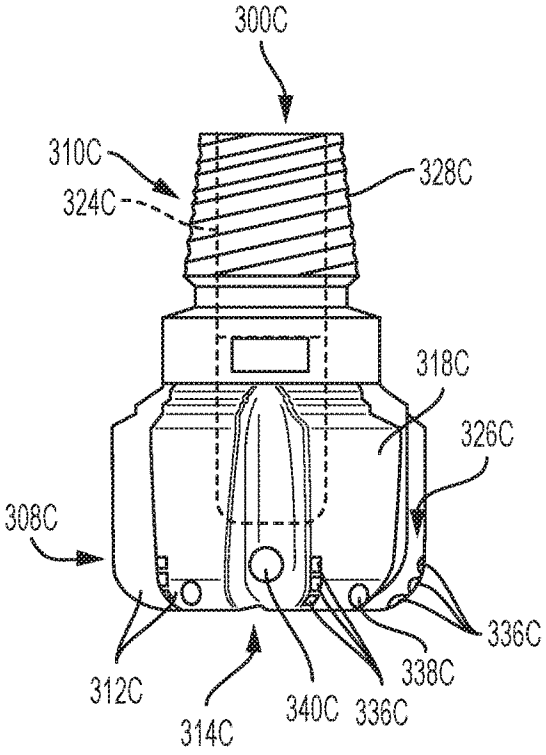
FIGS. 4A-4C illustrate a method of fabricating a drill bit body according to an embodiment of the present disclosure.
Figure 4B:
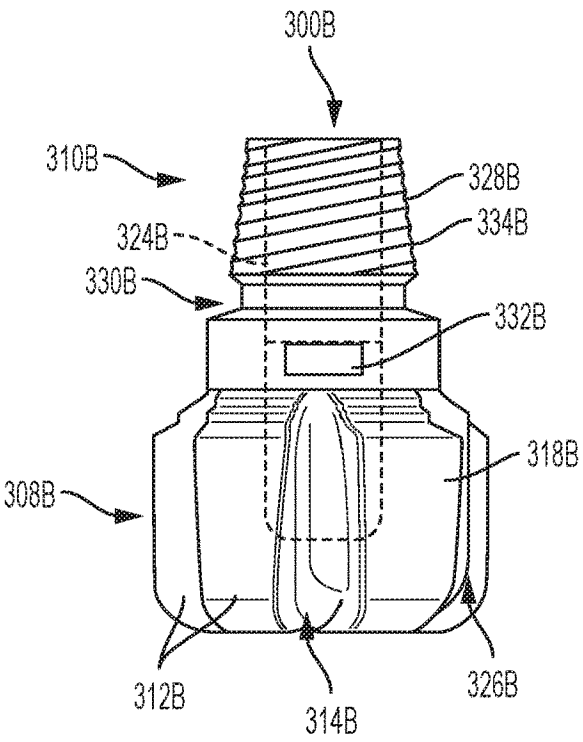
Figure 4A:
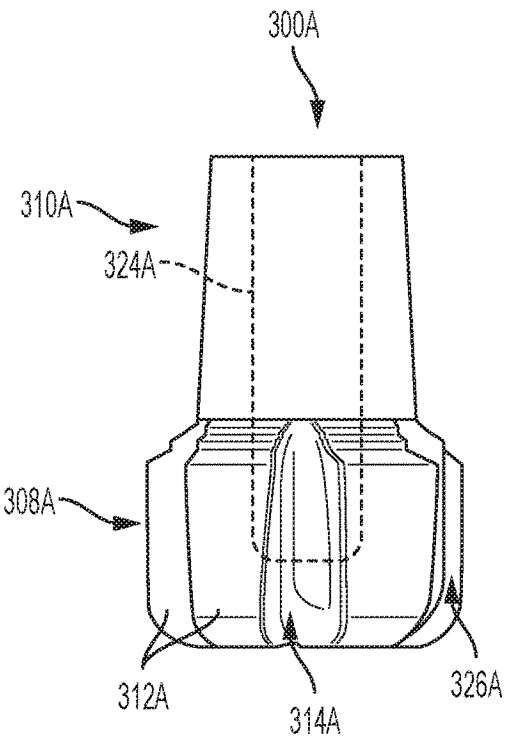

FIGS. 4A-4C illustrate a method of fabricating a drill bit body 300C from a forged drill bit body intermediate structure 300A. The forged intermediate structure 300A shown in FIG. 4A may be forged as described above. Thus, the forged intermediate structure 300A, in its forged state prior to further processing, may include a crown portion 308A, a shank portion 310A, blades 312A, and junk slots 314A between the blades 312A. Optionally, the forged intermediate structure 300A may include a central fluid conduit 324A and/or hard-facing grooves 326A. The blades 312A and junk slots 314A may, in some embodiments, be provided by forging to a final or near-final shape and configuration, exclusive of pockets to be formed in the blades and nozzle holes to be formed in the forged intermediate structure 300A, as explained below. In some embodiments, the forged intermediate structure 300A may be heat-treated after forgoing to improve mechanical properties.

In some embodiments, multiple specimens of the forged intermediate structure 300A, prior to or after heat-treating, may be carried in inventory. When a bit body is to be formed, the forged intermediate structure 300A may be removed from inventory for further processing, as described below.

Referring to FIG. 4B, an intermediate structure 300B may be formed by further processing of the forged intermediate structure 300A (FIG. 4A). The intermediate structure 300B may include a crown portion 308B, a shank portion 310B, blades 312B, junk slots 314B between the blades 312B, a gage portion 318B on an upper portion of the blades 312B, and hard-facing grooves 326B. For example, the shank portion 310B may be machined (e.g., turned, milled, cut) to form a tapered connection portion 328B, a radial groove 330B, and flats 332B for loosening or tightening a drill bit body formed from the intermediate structure 300B to an adjacent sub, drill collar, or drill pipe, for example. Threads 334B may be formed in the tapered connection portion 328B to provide a threaded connection to an adjacent sub, drill collar, or drill pipe, for example. If not previously formed during the forging operation, a central fluid conduit 324B may be formed in the intermediate structure 300B.

In some embodiments, one or more surfaces of the blades 312B may be machined to tailor the intermediate structure 300B for a specific application. For example, a length of a gage portion 318B of the blades 312B may be shortened by removing (e.g., machining, grinding, milling, turning, cutting, etc.) an upper portion of the gage portion 318B. The gage portion 318B may also be modified (e.g., by machining, addition of hard-facing material, etc.) to remove the draft angle provided to facilitate the forging operation. Similarly, a surface of the blades 312B may be machined to modify a profile of the blades 312B. Thus, the intermediate structure 300B may be tailored and modified to provide bit bodies having different designs and cutting (e.g., earth-boring) properties.

In some embodiments, multiple specimens of the intermediate structure 300B, including the central fluid conduit 324B, the tapered connection portion 328B (with or without threads 334B), the radial groove 330B, and the flats 332B, may be carried in inventory. When a bit body is to be formed, the intermediate structure 300B may be removed from inventory for further processing, as described below.

Referring to FIG. 4C, a drill bit body 300C may be formed by further processing of the intermediate structure 300B (FIG. 4B). The drill bit body 300C may include a crown portion 308C, a shank portion 310C including a tapered pin connection portion 328C, blades 312C, junk slots 314C between the blades 312C, a gage region 318C on an upper portion of the blades 312C, a central fluid conduit 324C, and hard-facing grooves 326C. Cutter pockets 336C may be formed in and along the blades 312C. The cutter pockets 336C may be formed in various configurations, such as numbers, sizes, depths, angles (e.g., rake angles), and positions of the cutter pockets 336C, to provide a drill bit formed from the drill bit body 300C with different designs and cutting (e.g., earth-boring) properties. In some embodiments, wear button pockets 338C may also be formed in the blades 312C for receiving wear buttons, which may also serve as depth of cut limiters, if for example, placed in the cone of the bit face and exhibiting sufficient surface area to not exceed the compressive strength of the formation being drilled under selected weight on bit (WOB). The formation of cutter pockets and wear button pockets in various configurations is described below with reference to FIGS. 5 and 6. In addition, nozzle holes 340C may be formed through the face of the drill bit body 300C to provide fluid communication between the central fluid conduit 324C and the junk slots 314C. The nozzle holes 340C may be formed in various configurations, such as numbers, sizes, and positions of the nozzle holes 340C, to provide a drill bit formed from the drill bit body 300C with different designs and fluid (e.g., cooling, removal of cuttings) properties. The formation of nozzle holes in various configurations is described below with reference to FIGS. 7 and 8.

After the drill bit body 300C is formed as described above with reference to FIGS. 4A-4C, a final, operational drill bit may be formed by securing cutters (e.g., polycrystalline diamond cutters) in the cutter pockets 336C, securing wear buttons in the wear button pockets 338C (if present), securing nozzles in the nozzle holes 340C, and adding hard-facing material within the hard-facing grooves 326C (and in any other desired location on the drill bit body 300C, such as on the gage region 318C).

Figure 5:
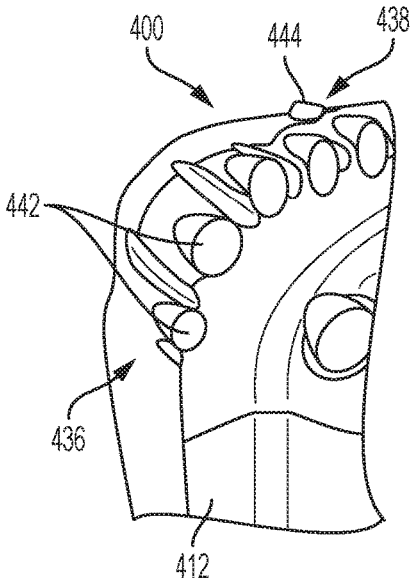
FIG. 5 shows a partial perspective view of a drill bit body according to an embodiment of the present disclosure.
Figure 6:
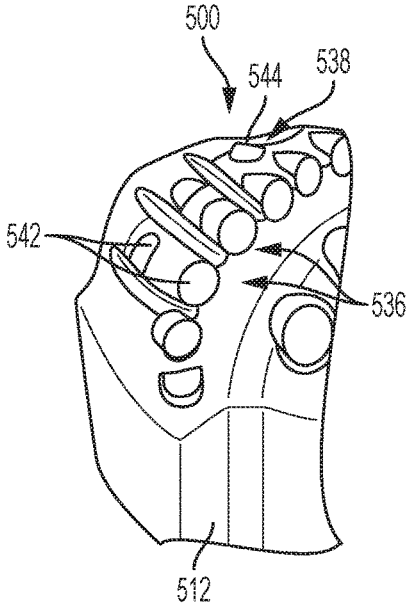
FIG. 6 shows a partial perspective view of a drill bit body according to another embodiment of the present disclosure.

FIG. 5 shows a partial perspective view of a drill bit body 400, including a blade 412 having cutters 442 within cutter pockets 436 and wear buttons 444 within wear button pockets 438 in a first cutter pocket configuration (e.g., number, size, position, angle, etc.). FIG. 6 shows a partial perspective view of a drill bit body 500, including a blade 512 having cutters 542 within cutter pockets 536 and wear buttons 544 within wear button pockets 538 in a second, different cutter pocket configuration. The respective drill bit bodies 400 and 500 of FIGS. 5 and 6 may be formed from a common drill bit body intermediate structure design and configuration by forming a different number, placement, size, and/or angle of the cutter pockets 436, 536 and wear button pockets 438, 538. For example, the drill bit body 400 of FIG. 5 may include relatively larger cutter pockets 436 for relatively larger cutters 442 and may lack backup cutter pockets and corresponding backup cutters, while the drill bit body 500 of FIG. 6 may include relatively smaller cutter pockets 536 for relatively smaller cutters 542 and may include backup cutter pockets 536 and corresponding backup cutters 542.

Figure 7:
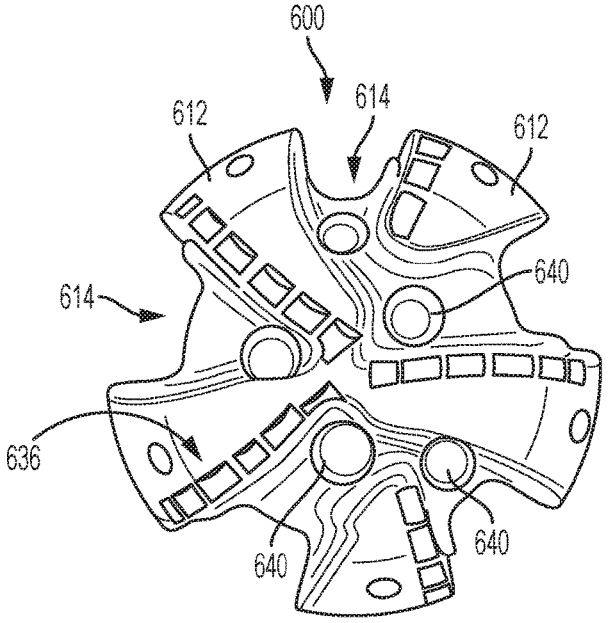
FIG. 7 shows a bottom view of a drill bit body according to an embodiment of the present disclosure.
Figure 8:
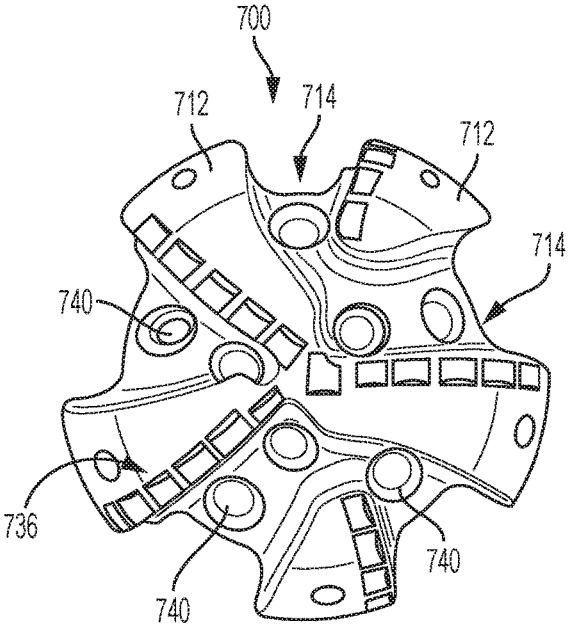
FIG. 8 shows a bottom view of a drill bit body according to another embodiment of the present disclosure.

FIG. 7 shows a bottom view of a drill bit body 600, including blades 612 having cutter pockets 636 formed therein, junk slots 614 between the blades 612, and nozzle holes 640 in the drill bit body 600. The nozzle holes 640 may have a first nozzle hole configuration (e.g., number, size, position, angle, etc.). FIG. 8 shows a bottom view of a drill bit body 700, including blades 712 having cutter pockets 736 formed therein, junk slots 714 between the blades 712, and nozzle holes 740 in the drill bit body 700. The nozzle holes 740 may have a second, different nozzle hole configuration. The respective drill bit bodies 600 and 700 of FIGS. 7 and 8 may be formed from a common drill bit body intermediate structure design and configuration by forming a different number, placement, size, and/or angle of the nozzle holes 640, 740. The nozzles holes 640, 740 may be machined to receive a sleeve of a nozzle assembly (not shown), into which a nozzle insert may be threaded or otherwise secured (such as by, for example, a weld bead or an interference fit), as is known in the art. Alternatively, the nozzle holes 640, 740 may be threaded or otherwise configured to receive a nozzle insert directly therein.

Figure 9:
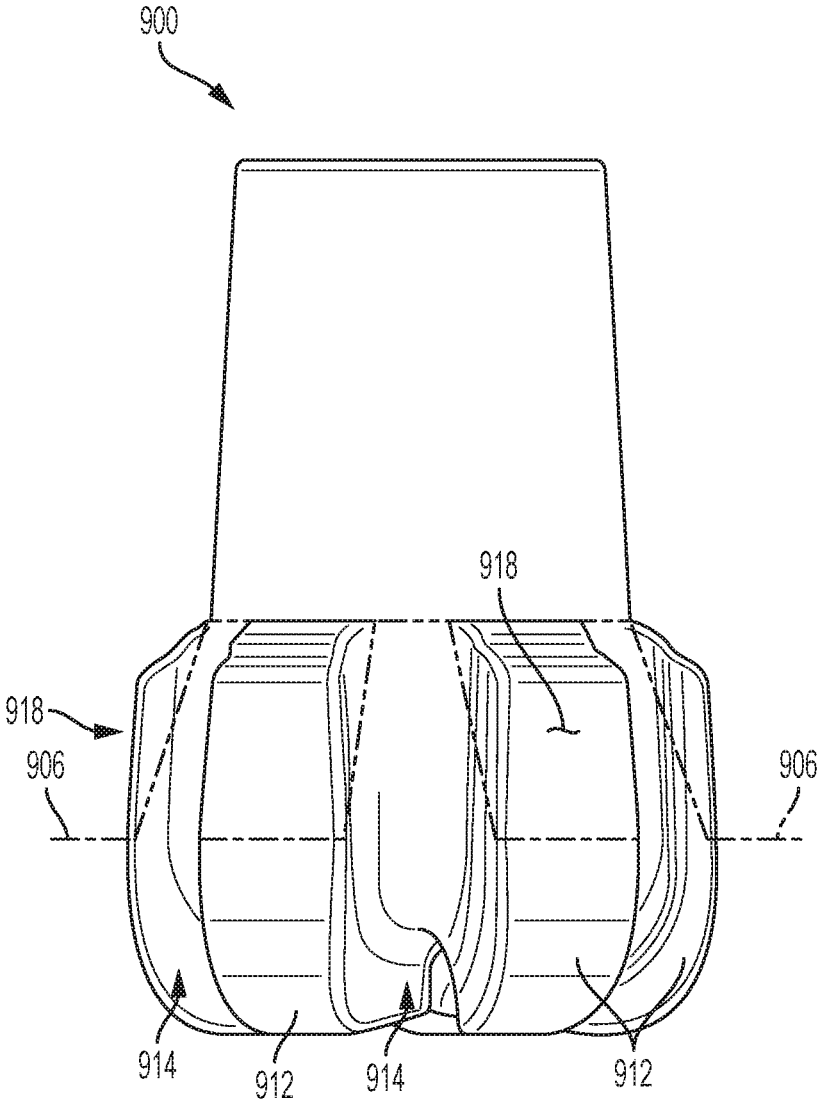
FIG. 9 shows a side view of a drill bit body intermediate structure according to another embodiment of the present disclosure.

Although the embodiments described above and shown with reference to FIG. 1 and FIG. 3 illustrate respective planar split lines 106, 206 defined by a location where first and second forging dies may be brought together during a forging operation, the present disclosure is not so limited. Thus, in some embodiments, a split line may have a non-planar configuration. By way of example and not limitation, as illustrated in FIG. 9, a drill bit body intermediate structure 900 may include a split line 906 that extends along an intermediate or lower portion of gage regions 918, upward from the gage regions 918 and alongside surfaces of blades 912 toward upper portions of junk slots 914, across the upper portions of the junk slots 914, and back downward along the side surfaces of the blades 912 toward the gage regions 918. In additional embodiments, other split line configurations are contemplated by this disclosure and may be selected by one skilled in the art of forging operations and/or drill bit design.

Accordingly, the methods of the present disclosure enable customization of drill bit bodies from a common, standardized intermediate structure. Customization may be available for various design parameters. By way of example and not limitation, drill bit bodies fabricated from a common, standardized intermediate structure may include one or more of: different cutter configurations, different wear button configurations, different nozzle configurations, different gage lengths, and different hard-facing material placement. Time, material, and manufacturing costs of fixed-cutter drill bits of a number of designs may be reduced when employing the present disclosure, compared to conventional fixed-cutter drill bits.

The embodiments of the disclosure described above and illustrated in the accompanying drawing figures do not limit the scope of the invention, since these embodiments are merely examples of embodiments of the disclosure. The invention is encompassed by the appended claims and their legal equivalents. Any equivalent embodiments lie within the scope of this disclosure. Indeed, various modifications of the present disclosure, in addition to those shown and described herein, such as other combinations and modifications of the elements described, will become apparent to those of ordinary skill in the art from the description. Such embodiments, combinations, and modifications also fall within the scope of the appended claims and their legal equivalents.

What is claimed is:

1. A method of forming a fixed-cutter earth-boring drill bit, comprising:

forging a plurality of drill bit intermediate structures, each of the drill bit intermediate structures comprising a crown portion and a shank portion in an integral, unitary body of a steel material, the crown portion including blades, junk slots between the blades, and hard-facing grooves along leading edges of the blades without machining at least the shank portion, at least the shank portion comprising a central fluid conduit without machining, each of the drill bit intermediate structures being substantially identical in drill bit design;

retrieving a forged steel drill bit intermediate structure from the plurality of drill bit intermediate structures;

forming threads on the shank portion of the retrieved, forged steel drill bit intermediate structure to form a connection region for connecting the shank portion to an adjacent sub, a drill collar, or a drill pipe in accordance with a customized design for the fixed-cutter drill bit;

forming cutter pockets along the blades of the retrieved, forged steel drill bit intermediate structure in accordance with the customized design for the fixed-cutter drill bit;

forming nozzle holes to provide fluid communication between the junk slots and the central fluid conduit of the retrieved, forged steel drill bit intermediate structure in accordance with the customized design for the fixed-cutter drill bit;

depositing a hard-facing material within the hard-facing grooves of the retrieved, forged steel drill bit intermediate structure; and positioning cutters within the cutter pockets of the retrieved, forged steel drill bit intermediate structure.

2. A method of forming a fixed-cutter drill bit for earth-boring operations, the method comprising:

retrieving a forged steel drill bit body from an inventory of substantially identical forged, unmachined steel drill bit bodies, each of the substantially identical forged, unmachined steel drill bit bodies comprising a crown portion and a shank portion forged as an integral, unitary body, the crown portion including fixed blades, junk slots between the fixed blades, and hard-facing grooves located along at least leading edges of the fixed blades, at least the shank portion comprising a central internal fluid conduit;

forming cutter pockets in the fixed blades in accordance with a customized design for the fixed-cutter drill bit; and forming nozzle holes in the forged steel drill bit body to provide fluid communication from the central fluid conduit to the junk slots in accordance with the customized design for the fixed-cutter drill bit.

3. The method of claim 2, wherein retrieving the forged steel drill bit body from the inventory comprises retrieving a forged and heat treated steel drill bit body from the inventory.

4. The method of claim 2, wherein retrieving the forged steel drill bit body from an inventory comprises retrieving a forged steel drill bit body including a threaded connector machined into the shank portion of the forged steel drill bit body, the threaded connector configured for connecting the forged steel drill bit body to a drill pipe, an adjacent sub, or a drill collar.

5. The method of claim 2, further comprising:

forging another steel drill bit body including fixed blades, the another steel drill bit body being at least substantially identical to the forged steel drill bit body retrieved from the inventory in shape and configuration; and forming cutter pockets in a configuration along the fixed blades of the another steel drill bit body, the configuration being different than a configuration in which the cutter pockets are formed in the forged steel drill bit body retrieved from the inventory in accordance with another customized design for the another steel drill bit body.

6. The method of claim 5, further comprising forming the nozzle holes through the forged steel drill bit body at locations relative to the forged steel drill bit body and forming nozzle holes through the another forged steel drill bit body at locations relative to the another forged steel drill bit body, the locations relative to the another forged steel drill bit body being different than the locations relative to the forged steel drill bit body in accordance with the another customized design for the another steel drill bit body.

7. The method of claim 5, further comprising heat treating the forged steel drill bit body prior to forming the cutter pockets therein and heat treating the another forged steel drill bit body prior to forming the cutter pockets therein.

8. The method of claim 5, further comprising forming threads on a connector on the forged steel drill bit body prior to forming the cutter pockets therein and forming threads on a connector on the another forged steel drill bit body prior to forming the cutter pockets therein.

9. The method of claim 5, wherein forging the another forged steel drill bit body comprises positioning a split line between a first forging die and a second forging die between a top and a bottom of a gage portion of the fixed blades of the another forged steel drill bit body.

10. The method of claim 9, wherein forging the another forged steel drill bit body comprises providing exterior surfaces of the another forged steel drill bit body tapering away from the split line at a draft angle of more than zero degree from a central longitudinal axis of the another forged steel drill bit body.

11. The method of claim 5, wherein forging the another forged steel drill bit body comprises forging a crown portion and a shank of the another forged steel drill bit body as an integral, unitary body.

12. The method of claim 11, further comprising, after forging the another forged steel drill bit body, machining a tapered connection portion in the shank.

13. The method of claim 5, wherein forging the another forged steel drill bit body comprises forging a drill bit body crown to be connected to a shank of the another forged steel drill body.

14. The method of claim 5, wherein forging the another forged steel drill bit body comprises forming hard-facing grooves along leading edges of the fixed blades of the another forged steel drill body.

15. The method of claim 5, wherein forging the another forged steel drill bit body comprises forming a central internal conduit within the another forged steel drill bit body.

16. The method of claim 5, wherein forming the cutter pockets in the configuration on the forged steel drill bit body comprises forming the cutter pockets having locations relative to the forged steel drill bit body and wherein forming the cutter pockets in the configuration on the another forged steel drill bit body comprises forming the cutter pockets having locations relative to the another forged steel drill bit body different than the locations relative to the forged steel drill bit body.

17. The method of claim 2, further comprising forming threads on the shank portion to form a connecting portion of the fixed-cutter drill bit.

* * * * *